United States Patent [19]

Ammitzboll

[11] Patent Number: 4,689,818

[45] Date of Patent: Aug. 25, 1987

[54] RESONANT PEAK CONTROL

[75] Inventor: Knud Ammitzboll, New Providence, N.J.

[73] Assignee: Siemens Hearing Instruments, Inc., Union, N.J.

[21] Appl. No.: 489,653

[22] Filed: Apr. 28, 1983

[51] Int. Cl.[4] ..... H04R 25/00; H04R 3/02

[52] U.S. Cl. ..... 381/68; 381/68.2; 381/93; 381/98

[58] Field of Search ..... 179/107 R, 107 FD; 381/68, 93, 107, 95, 96, 98, 68.2

[56] References Cited

U.S. PATENT DOCUMENTS

| | | | |
|---|---|---|---|
| 2,390,794 | 12/1945 | Knight | 381/68 |
| 2,393,184 | 1/1946 | Passow | 381/68 |
| 3,317,671 | 5/1967 | Mitchell | 381/68 |
| 3,368,644 | 2/1968 | Henderson | 181/23 |
| 3,571,514 | 3/1971 | Wruk | 381/68 |
| 3,764,745 | 10/1973 | Bottcher et al. | 381/68 |
| 3,849,602 | 11/1974 | Gendin | 381/98 |
| 3,995,114 | 11/1976 | Marschinke | 381/68 |
| 4,046,960 | 9/1977 | Veale | 381/103 |
| 4,211,898 | 7/1980 | Atoji et al. | 179/156 R |
| 4,426,622 | 1/1984 | Rittenbach | 329/143 |
| 4,538,298 | 8/1985 | Bose | 381/98 |
| 4,543,453 | 9/1985 | Brander | 381/68 |

FOREIGN PATENT DOCUMENTS

| | | | |
|---|---|---|---|
| 1252747 | 10/1967 | Fed. Rep. of Germany | 381/93 |
| 2807452 | 8/1979 | Fed. Rep. of Germany | 381/93 |
| 3047691 | 12/1980 | Fed. Rep. of Germany . | |
| 57-69000 | 4/1982 | Japan . | |
| 474200 | 7/1969 | Switzerland . | |
| 1597501 | 9/1981 | United Kingdom | 381/93 |

*Primary Examiner*—Gene Z. Rubinson
*Assistant Examiner*—Danita R. Byrd
*Attorney, Agent, or Firm*—Mark H. Jay

[57] ABSTRACT

A hearing aid having a microphone, an amplifier and a receiver for delivering the amplified sound to a user's ear, in which an adjustable resonant peak control is used to shift the frequency response of the amplifier to a lower frequency range in order to reduce feedback without substantial reduction in high frequency amplification or saturation levels.

4 Claims, 3 Drawing Figures

RESONANT PEAK CONTROL

BACKGROUND OF THE INVENTION

This invention relates to a hearing aid in which acoustic feedback is controlled.

Acoustic feedback, a common problem in both in-the-ear and behind-the-ear hearing aids, can be eliminated in some users by placement of a capacitor in parallel with the hearing aid amplifier output. However, this does not allow adjustments at the time of fitting the hearing aid and therefore, feedback cannot be eliminated in all users.

A high frequency cutoff circuit can be used to eliminate feedback, but it also entirely eliminates the high frequency response of the hearing aid.

Accurate ear impressions coupled with precise duplication at the laboratory can provide a precise fit for the hearing aid which is helpful in reducing feedback. However, often the hearing aid must be returned to the laboratory for minor corrections due to inaccuracies in the original impressions or in the duplications.

SUMMARY OF THE INVENTION

In general, the invention features, in one aspect, a hearing aid having receiving means for receiving sound, amplifying means, connected to the receiving means, for amplifying sound, and a resonant peak control connected between the receiving and amplifying means, for reducing feedback by varying the amplifying means frequency response.

In a particular embodiment, the resonant peak control of the hearing aid allows the frequency response to be tailored to reduce feedback without substantial reduction in high frequency amplification by the amplifying means; the resonant peak control is an R-C circuit; the R-C circuit is a series R-C circuit having a variable resistor and a capacitor.

In another particular embodiment, the hearing aid has an adjustable vent which can be used to reduce feedback; the adjustable vent and the resonant peak control are coordinated to reduce feedback. in another aspect, the invention features a method of reducing feedback in a hearing aid, having the steps of adjusting the volume of the hearing aid to the most comfortable level and tailoring the frequency response of the hearing aid output to reduce feedback.

In a particular embodiment, the tailoring of the frequency response is accomplished by tuning a series R-C circuit in parallel with a hearing aid output.

This invention is very significant step in the elimination of acoustic feedback in hearing aids because it allows the hearing aid to be adjusted for the elimination of feedback at the time of fitting.

On the spot adjustments, obtained by varying the resonant peak control, allow the hearing aid to be customized to an individual user without the necessity of returning the aid to the factory or laboratory for adjustments or modifications. This allows accomodation of individual characteristics of a user's ear canal in obtaining the most comfortable level for that particular user.

Adjustment of the resonant peak control flattens out the frequency response and shifts the frequency curve to a lower frequency range, resulting in almost no loss in high frequency amplification and only a minimal change in saturation levels.

Therefore, this hearing aid provides the advantage of being adjustable at the time of fitting without any significant sacrifice in operational characteristics.

Other features and advantages of the invention will be apparent from the following detailed description, and from the claims.

For a full understanding of the present invention, reference should now be made to the following detailed description and to the accompanying drawings.

DETAILED DESCRIPTION

Figure 1:
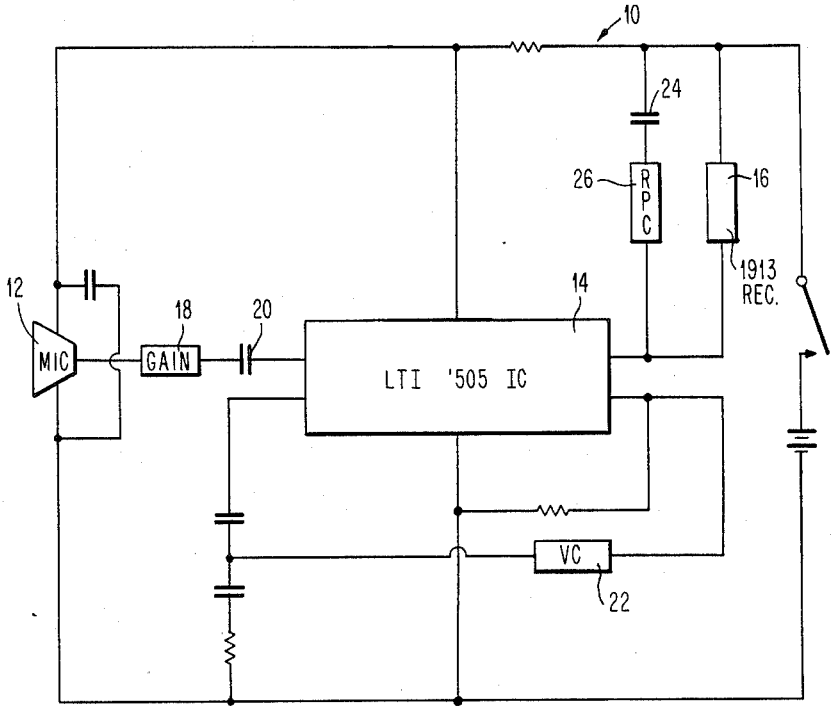
FIG. 1 is a diagrammatic view of the hearing aid circuitry.

Referring to the drawings, an embodiment of the invention will now be described in detail.

Hearing aid 10, designed to be mounted in the user's ear, has microphone 12 for picking up external sounds, integrated circuit 14, typically an LTI 505 integrated circuit, for amplifying external sound, and receiver 16, typically a Knowles Electronics 1913 receiver for imparting the amplified sound to the user.

Microphone 12, is connected to integrated circuit 14 by gain control 18, which can be a potentiometer in series with capacitor 20, for adjusting the gain of the microphone.

Volume control 22, which can also be a potentiometer, allows variable adjustment of the amplified audio output of integrated circuit 14.

Reciever 16, connected in parallel with integrated circuit 14, is also connected in parallel with a series R-C circuit which includes capacitor 24 and resonant peak control (RPC) 26.

The resonant peak control is a variable potentiometer which when adjusted acts in conjunction with capacitor 24 and the inductance of receiver 16 to tailor the frequency response of the amplifier (integrated circuit 14) to reduce instability due to feedback.

Figure 2:
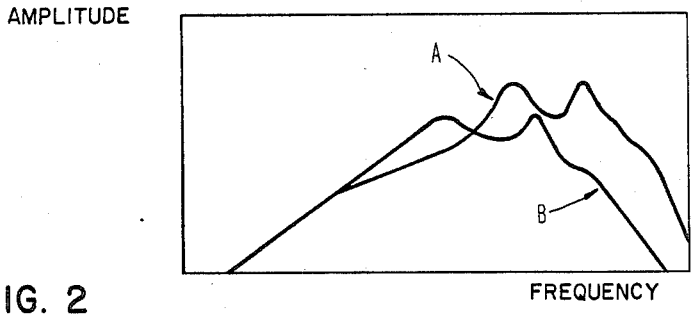
FIG. 2 shows the boundaries of the frequency response curve due to adjustment of the resonant peak control.

Referring to FIG. 2, frequency response curves A and B show the two extreme conditions between which the frequency response can be tailored by adjusting the resonant peak control.

The adjustment of the resonant peak control varies its electrical output which tunes or tailors the frequency response resulting in shifting and flattening of the peaks of the frequency response curve which reduces feedback with only a slight reduction in high frequency amplification and only a minimal change in the saturation curve.

Figure 3:
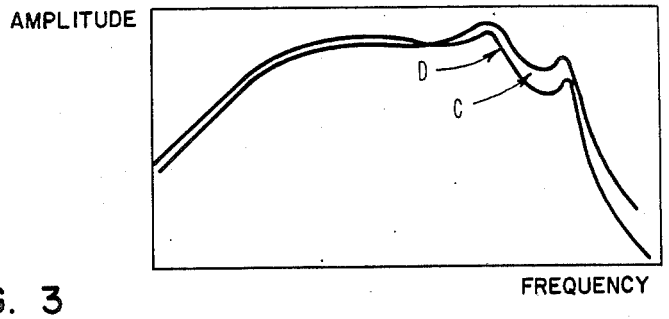
FIG. 3 shows the boundaries of the saturation sound pressure level curve due to adjustment of the resonant peak control.

Referring to FIG. 3, curves C and D show the limits of the change in the saturation curve due to adjustment of the resonant peak control.

In actual use the slight reduction in high frequency amplification is not detectable because the improved flatness of the frequency response permits a higher gain to be utilized.

In actual operation the hearing aid is inserted in the user's ear and volume control 22, is adjusted to the most comfortable level for the particular user. In the event feedback occurs prior to reaching the most comfortable level, resonant peak control 26 is adjusted until feedback is eliminated. Then, if required volume control 22 can be further increased to again reach the most comfortable level. The sequence of maximizing the volume control to the most comfortable level followed by adjustment of the resonant peak control is repeated util the most comfortable level for the user is attained without the existence of any feedback.

Siemens Custom In-The-Ear Hearing Aid 007, sold by Siemens Hearing Instruments, Inc., 685 Liberty Avenue, Union, N.J., incorporates the inventive concept described in this application.

In an alternative embodiment the size of the hearing aid vent opening can be changed to effect a change in amplifier instability (integrated circuit 14) due to feedback.

This modification of the opening is especially useful when a maximum resonant peak control adjustment is reached and feedback still occurs.

There has thus been shown and described a novel method and apparatus for reducing acoustical feedback in hearing aids which fulfills all the objects and advantages sought therefor. Many changes, modifications, variations and other uses and application of the subject will, however, become apparent to those skilled in the art after considering the specification and the accompanying drawings which disclose embodiments thereof. All such changes, modifications, variations and other uses and applications which do not depart from the spirit and scope of the invention are deemed to be covered by the invention which is limited only by the claims which follow.

What is claimed is:

1. A hearing aid, comprising:

(a) a receiver having an inductive characteristic and a frequency response curve, the receiver operating to convert electrical signals into audible sound; and (b) an adjustable electrical network in parallel with the receiver, the network having an RC characteristic chosen to coact with the inductive characteristic of the receiver in a manner that peaks in the response curve of the receiver are reduced by an amount which depends upon adjustment of the network.

2. The hearing aid of claim 1, wherein the network comprises a resistance and capacitance in series.

3. The hearing aid of claim 2, wherein the resistance is variable.

4. The hearing aid of claim 1, further comprising an amplifier having an output connected to the receiver and to the network, and means for varying an output signal at said output.

* * * * *